United States Patent [19]

Flatt et al.

[11] 4,008,983

[45] Feb. 22, 1977

[54] TIP TURBINE INFLATING DEVICE WITH MOTOR-ACTUATED CLOSURE AT INLET

[75] Inventors: Joseph Flatt, Dayton; Robert C. LoPiccolo, Bellbrook; Eugene Linsker, Kettering, all of Ohio

[73] Assignee: Tech Development Inc., Dayton, Ohio

[22] Filed: Nov. 27, 1974

[21] Appl. No.: 527,745

[52] U.S. Cl. ..... 417/348; 417/355; 9/315; 415/157; 137/535

[51] Int. Cl.[2] ..... F04B 17/00; F04B 35/00; B63C 7/16

[58] Field of Search ..... 417/89, 191, 197, 348, 417/355; 415/157, 158; 9/11 A, 315, 316; 251/62, 147; 137/535

[56] References Cited

UNITED STATES PATENTS

| | | | |
|---|---|---|---|
| 2,100,185 | 11/1937 | Engstrand | 417/197 X |
| 2,761,617 | 9/1956 | Van Ornum et al. | 417/355 |
| 2,906,447 | 9/1959 | Seed | 9/315 X |
| 3,056,540 | 10/1962 | Marsh et al. | 417/191 X |
| 3,460,746 | 8/1969 | Green et al. | 417/174 |
| 3,468,472 | 9/1969 | Hahn | 417/191 |
| 3,684,404 | 8/1972 | Galbraith | 417/191 X |
| 3,771,913 | 11/1973 | MacPherson et al. | 417/191 X |

FOREIGN PATENTS OR APPLICATIONS

| | | | |
|---|---|---|---|
| 197,914 | 11/1923 | United Kingdom | 417/355 |
| 1,194,041 | 6/1970 | United Kingdom | 415/157 |

*Primary Examiner*—Carlton R. Croyle
*Assistant Examiner*—Thomas I. Ross
*Attorney, Agent, or Firm*—Jerome P. Bloom

[57] ABSTRACT

A tip turbine type fan particularly adapted for use to effect a substantially instantaneous inflation of an emergency lifesaving device such as an escape slide or life raft. It features a housing having an improved unitized construction which defines an axial flow passage. A rotor within and transverse to said passage is operated under the influence of fluid under pressure directed from a chamber formed within and circumferentially of the wall structure of said housing. Drive of the rotor induces air from the environment surrounding the housing to enter the flow passage at one end to co-mingle with the fluid furnishing the motive power for the rotor and to move therewith from the passage to the interior of a connected article to be inflated.

It is a feature of a preferred embodiment of the invention that the entrance to the flow passage is bridged by a platelike closure device which is normally biased to a position to seal the entrance to said flow passage. Means are included to provide that this plate will be axially displaced from the entrance to the flow passage to permit the inflow of air under the influence of the operation of said rotor substantially simultaneously with the energizing of said rotor. In moving to its axially displaced position the closure plate is adapted to also serve as a buffer plate or shield to inhibit and limit water from entering and being sucked through said flow passage where the device to be inflated and consequently the fan may be exposed to or partially immersed in water.

A pair of fans such as here described may be employed in a reversely oriented generally parallel relation to achieve improvements in systems for controlling the lift, flotation and let down or braking of airborne, terrestrial and marine vehicles with reference to a surface defining a base plane.

11 Claims, 9 Drawing Figures

2
92
88
86
10
122
98
118
14
124
2

50
58
62
38
36
42
20
40
32

84
14
84

92
88
86
90
66
72
14
126
68
74
82
76
84
54
24
16
28
30
4
4
19
18
70
60
43
62
58
21
124
128
46
32
12
48
20
130
61
35
42
50
132
22
44
52
26
80
82
94
78
114
108
56
122
106
116
96
110
112
134
100
136
98
102
104
10

124
122
114
120
112
134
100
118
110
116

TIP TURBINE INFLATING DEVICE WITH MOTOR-ACTUATED CLOSURE AT INLET

BACKGROUND OF THE INVENTION

This invention relates to an improved tip turbine type fan constituting an inflating device. By way of example the invention improvements are here disclosed as embodied in a type of inflating unit such as illustrated in applicants' prior patent application Ser. No. 304,095, now U.S. Pat. No. 3,904,324 dated Sept. 9, 1975. Preferred embodiments of the present invention feature a unitized housing defining an axial flow passage for directing an inflating medium to a coupled inflatable article, the entrance to which flow passage is provided with a sealing system including means normally operative to maintain a tight and effective seal of said flow passage. Means are provided to dictate that said sealing means will automatically displace from a sealing position substantially simultaneously with an energizing of said fan to inflate a coupled inflatable object.

The characteristics of the invention embodiments enable their application also to effect important improvements in available systems for controlling the lift, flotation and let down or braking of airborne, terrestrial and marine vehicles with reference to a surface defining a base plane.

For the purpose of illustrating the invention, a preferred embodiment will be particularly described with reference to its application to an inflatable life raft. Its application to effect an improved system for controlling the flotation and braking of a moving vehicle will also be described. However, though the description of the invention is thus limited, it should nevertheless be obvious that the application of the invention is not so limited and such is not intended.

Officials and regulatory agencies concerned with the safety of passengers of large aircraft, particularly those engaged in extended foreign flights, have been dissatisfied in many respects with the equipment available on such aircraft for disembarking passengers in the event of emergency and particularly in the event of the necessity of ditching an aircraft in water. Not only have the officials and regulatory agencies but also the aircraft manufacturers and owners thereof been concerned in this respect. This has led to an intensive effort to develop faster and safer means for disembarking passengers from an aircraft in the event of an emergency. Among the devices incorporated in aircraft for the purposes noted are inflatable slides which are extensible from an aircraft. Also to be included in aircraft which travel across the oceans are inflatable life rafts. It has been recognized that the ability to effectively use either the inflatable slides or the inflatable life rafts is dependent on having means which facilitate their quick and substantially immediate inflation. Heretofore devices provided for the purpose of inflation have left something to be desired. The time required for inflation of the prior art devices has not insured as significant a safety factor as desired. Moreover, since the inflating devices will in most instances be stored and inoperative for an extended period of time, the problem has existed that dust and dirt to which the same is potentially exposed in storage could cause malfunction of the inflating device at the precise time that it is needed. Also, for example, when a life raft is required, it is sometimes tossed in the water before inflation thereof is completed or even initiated. In such case, in using many prior art inflating devices their exposure to water can either nullify or make extremely difficult their capability of effectively inflating and/or maintaining the inflation of the life raft.

The potentially serious consequence of the deficiencies or potential malfunction of prior art inflating devices available for use in the applications noted exhibit problems the solutions of which are provided by the present invention.

The invention also provides an answer to a need for a more positive control of the lift, flotation and let down or braking of vehicles the under carriages of which feature an elastic inflatable trunk.

SUMMARY OF THE INVENTION

The invention provides a turbine type fan which is particularly adapted for coupling to inflatable articles used for safety purposes. Preferred embodiments of this fan include a housing having an inlet thereto and an outlet therefrom, means defining a flow passage interconnecting said inlet and said outlet, pumping means in said flow passage the operation of which will, if said flow passage is otherwise unobstructed, induce a through flow of air under pressure, and means embodied in said housing for directing fluid under pressure to operate said pumping means, said housing being distinguished by a tubular configuration of simplified construction defining an interior flow surface which facilitates a most smooth and effective direction of air for inflating purposes.

A significant feature of the invention is provided by means bridging the inlet to the fan adapted to continuously maintain a seal thereof as coupled to an article to be inflated, which seal protects the interior and working elements of the fan in a stored or inoperative condition. The device provided for sealing the fan inlet is so arranged as to be displaceable to permit inflow and passage of air to and through the fan flow passage substantially simultaneously with the energizing of the pumping means. This enables a substantially instantaneous inflation of a coupled article. In a preferred embodiment, the sealing means is a piston operated closure plate which normally maintains a seal except when the fan is energized, in which event the plate has a further capacity to displace and serve as a shield or buffer to protect the inlet to the fan against an insuction of an undersirable amount of water in the event it should be exposed to or partially immersed in water. In any event, once inflation is effected and the inflating device de-energized, the closure plate will automatically function to re-seal the fan inlet and prevent ingestion of water.

An application of a pair of the preferred invention embodiments oriented in a relatively reverse and in a generally parallel arrangement to selectively direct air under pressure to or extract air from the vicinity of an inflatable trunk forming an under carriage for a vehicle which is adapted to float over a water or ground base surface provides a new and improved system for the lift, flotation and let down or braking of such vehicles.

It is therefore a primary object of the invention to provide improved inflating apparatus having particular application for emergency usage.

Another object of the invention is to provide improved inflating apparatus which is normally sealed and capable of functioning on demand in a simple and safe manner.

An additional object of the invention is to provide an improved construction of turbine type fan units which makes them more economical to fabricate, more efficient and satisfactory in use and unlikely to malfunction.

A further object of the invention is to provide an improved construction of turbine type fan units which enable a new and more positive system for controlling lift, flotation and let down or braking of vehicles adapted to hover or float over a water or ground base surface.

Another object of the invention is to provide improved inflating apparatus and improvements in turbine type fan units used for such purposes possessing the advantageous structural features, the inherent meritorious characteristics and the means and mode of use herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents. Referring to the drawings wherein are shown some but not necessarily the only forms of embodiment of the invention, FIG. 1 is an end view of an illustrative embodiment of a turbine type fan unit providing an inflating pump in accordance with the invention;

FIG. 2 is a sectional view taken on line 2—2 of FIG. 1;

FIGS. 3, 4 and 5 each show details of portions of the pump structure illustrated in FIGS. 1 and 2;

Figure 1:
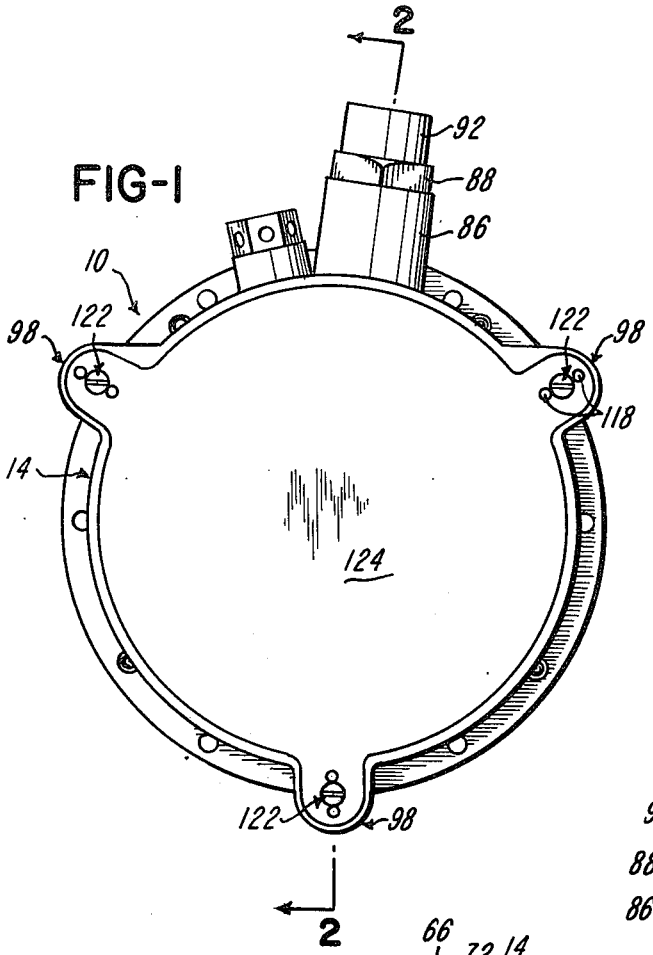
Figure 3:
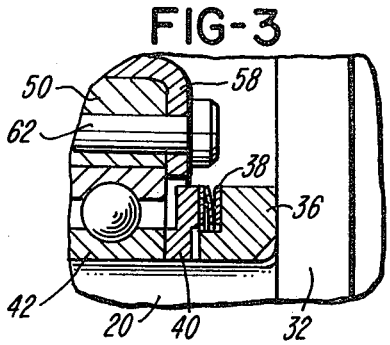
Figure 4:
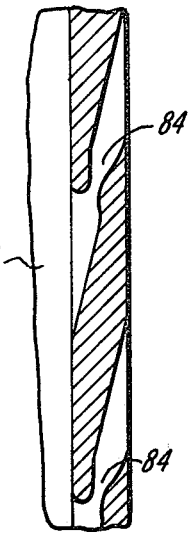
Figure 8:
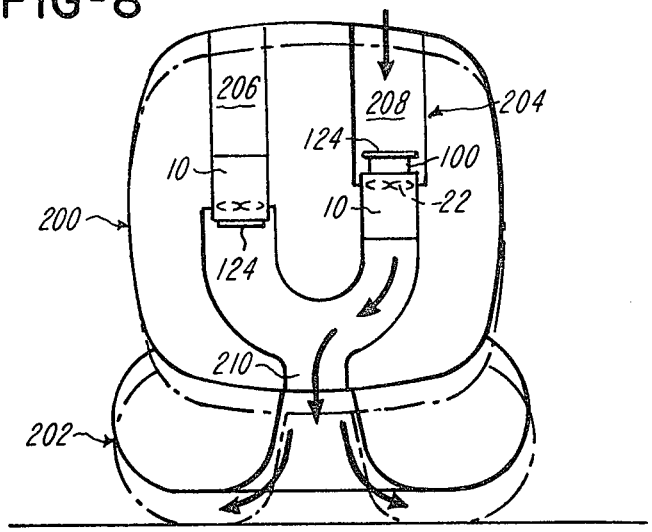
Figure 9:
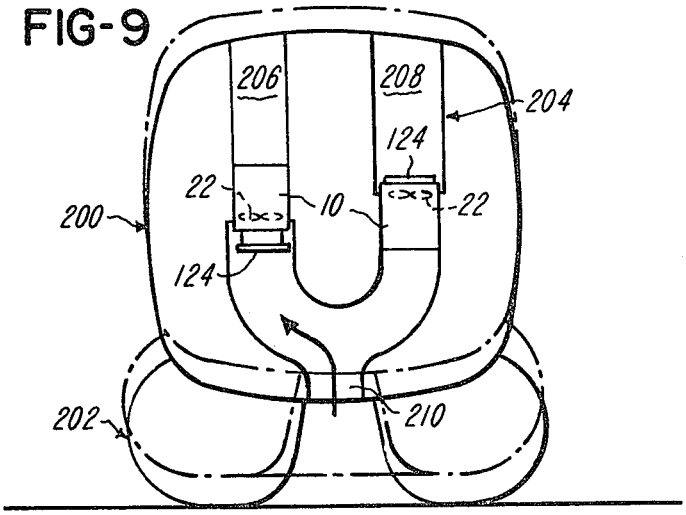

FIG. 8 is a schematic sectional view of an aircraft embodying a pair of the turbine type fan units of FIG. 1 in a manner to provide a control system for aiding the lift, flotation and landing or braking of an aircraft or like vehicle embodying, for its under carriage, an inflatable trunk; and FIG. 9 is a sectional view similar to that shown in FIG. 8 but differing in that the vehicle is illustrated in a landed or braked condition.

Like parts are indicated by similar characters of reference throughout the several views.

The embodiment of the invention here illustrated includes a housing 10 comprised of two tubular segments connected in end abutting coaxial relation to form a continuous flow passage 12. One segment provides an inlet section 14 while the second segment 16 provides a housing for a stator assembly 18, the hub 19 of which mounts a spindle 20 which mounts, in turn, a rotor assembly 22.

The hub 19 positions centrally of the housing segment 16, concentric with a central portion of its longitudinal extent which defines a stator ring section 24. Stator blades 26 arranged in a radially projected, circumferentially spaced relation, are fixed at their inner ends to hub 19 and suitably interconnected at their outer ends to the stator ring section 24. Immediately beyond the stator ring section 24, the housing segment 16 terminates, at its end remote from the inlet section 14, in a diffuser section 28. The latter is so formed that its interior wall surface has a conically expanded configuration, the projected expanded extremity of which defines the housing outlet 30. Other than in the area of its diffuser section 28, the housing segment 16 has a uniform internal diameter corresponding in dimension with that of the innermost end of the interior wall surface of the diffuser section 28.

The hub 19 has a cup-like configuration, the mouth of the cup being at the face thereof which is remote from the housing outlet 30 and the base of the cup having a central aperture 21. Seated within and to the base of this cup, in bridging relation to its central aperture 21, is the disc-like plate 32 formed integral with and projecting radially of one end of the spindle 20. This positions the longitudinal axis of the spindle 20 in a line coincident with that of the longitudinal axis of the housing 10 and at the radial center-line of the flow passage 12.

Mounted about the spindle 20 to abut the plate 32 is a ring-shaped spacer 36, followed, in succession, by a circular wave-formed spring 38, a pre-load washer 40, a bearing 42, a spacer sleeve 44, and a second bearing 43. The projected end portion 35 of the spindle 20 which is remote from the plate 32 and immediately following the bearing 43 is reduced in diameter and threaded. The reduction in diameter provides a shoulder to which is seated a lock washer 46, the radial extent of which is sufficient to cause it to overlap the inner race of the bearing 43. A nut 48 is threaded on the end portion 35 of the spindle 20 to fix the washer 46 in an abutted relation to the inner race of the bearing 43. The spacer sleeve 44 is a thin walled structure the projected extremities of which respectively abut the outer races of the bearing units 42 and 43. The radial outermost surfaces of the bearings 42 and 43 and the sleeve 44 provide a cylindrical surface over which is slip fit the annular hub 50 of the rotor assembly 22. Projected radially from and in circumferentially spaced connected relation to the hub 50 is a series of rotor blades 52. The outer ends of the blades 52 are interconnected with and commonly mount a turbine ring 54. The latter in turn, mounts, in fixed relation thereto, a series of radially projected, circumferentially spaced, turbine blades 56.

At its end immediately adjacent the stator hub 19, the rotor hub 50 is capped by an annular blade retainer plate 58. The inner peripheral portion of the plate 58 is arranged to overlap the outer face of the outer race of the bearing unit 42. The opposite end of the rotor hub 50 is capped by a spinner element 60, the abutted face of which has a recess which freely accommodates and nests the end portion 35 of the spindle 20 which mounts the lock washer 46 and the nut 48. The abutting faces of the spinner 60 and the rotor hub 50 are formed to telescopically nest as the spinner 60 is fixed in an axially projected relation to the rotor hub by the threaded engagement therein of the projected ends of bolts 62 thrust through aligned apertures in the blade retainer plate 58 and the rotor hub. As the heads of bolts 62 are drawn tight to the outer face of the retainer plate 58, not only is the spinner fixed to the rotor hub but the outer races of both bearing units 42 and 43 and the interposed spacer sleeve 44 are clamped therebetween.

The outermost surface 61 of the spinner 60 projects inwardly of the portion of the flow passage 12 which is defined by the inlet section 14 of the housing 10. The surface 61 has an aerodynamic shape, including a rounded nose portion which is smoothly extended by a peripheral surface which is conically divergent in the direction of the rotor hub. This conically divergent surface is extended in the direction of the stator assembly 18 by the conically expanding configuration of the outer surface of the rotor hub 50, the major diameter of which is equal to that of the stator hub 19.

Figure 2:
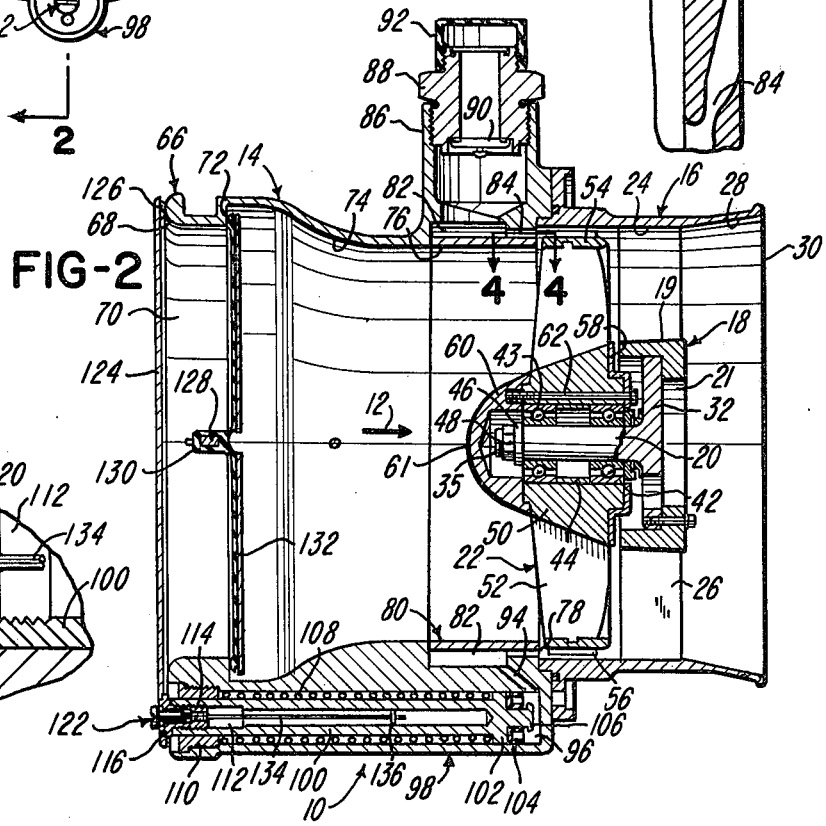
Figure 5:
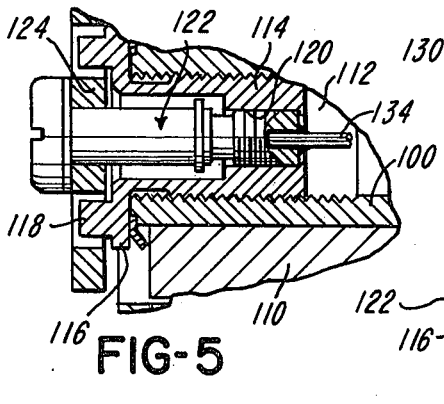

As seen in FIG. 2 of the drawings, the interior wall surface of the housing 10 which defines the flow passage 12 has a lead-in surface 66 provided by a lip 68 formed integral with its inlet end. Viewing the contour of the interior wall surface of the housing 10 in a longitudinal sense, it includes a short cylindrical inlet section 70 of uniform diameter forming an extension of the aerodynamically rounded surface 68 with which it smoothly merges. Immediately at the end of the section 70, the interior wall surface of the housing 10 is abruptly expanded to form, in the process, a radial shoulder 72 which faces the housing outlet 30. Thus, the cross section of the flow passage is abruptly expanded immediately following the inlet section 70. Immediately beyond the shoulder 72 there is a section 74 of the interior wall surface of the housing 10 which, in a longitudinal sense, smoothly and arcuately converges from its outer radial limit to reduce the cross section of the flow passage 12 to an extent that it is smaller in diameter than the inlet to the flow passage 12 when it reaches a plane transverse to the housing 10 which is adjacent and spaced from the end of the housing segment 14 which abuts one end of the housing segment 16. Following the section 74 thereof, the interior wall surface of the housing 10 is continued to the end of the housing segment 14 by a section 76 which uniformly maintains the reduced diameter achieved by the contour of the section 74. As may be seen in FIG. 2 of the drawings, immediately following the housing segment 14 the cross sectional area of the flow passage 12 is abruptly expanded by the increased diameter of that portion of the flow passage including the section 24 of the interior wall surface of the housing segment 16. This abrupt expansion of the cross sectional area of the flow passage 12 creates, as seen in FIG. 2 of the drawings, a radial shoulder 78 at the inner end of the housing section 14 which is rimmed by the interior wall section 24. Note, however, that the turbine ring 54 has an internal diameter corresponding to that of the wall section 76 and effectively forms an extension thereof which terminates immediately short of the stator blades 26. Of course, as may be seen, the discharge end of the flow passage 12 is conically expanded.

The section 76 of the interior wall surface of the housing segment 14 is provided by a nozzle ring segment 80 which is integrated with the housing wall structure to define the radial innermost wall of a circular chamber 82 which girdles or rings the flow passage 12, in a surrounding spaced relation thereto, at the end of the housing segment 14 immediately adjacent, spaced from, and in line with the turbine blades 56 on the ring 54. This chamber 82 is communicated with the blades 56 by nozzle passages 84 in the wall structure of the housing segment 14 which open from one end of the chamber 82 to align with and have their openings immediately adjacent the turbine blades 56. As seen further in FIG. 2 of the drawings, an opening through the radial outermost wall of the chamber 82 is defined by a radially projected tubular adapter 86 formed integral with the wall structure of the housing segment 14. Threadedly engaged in the radial outermost end of the adapter 86 is a tubular plug-like element 88 the passage through which is bridged at its innermost end by a conventional flapper valve schematically shown at 90. The outermost end of the plug 88 is shown to be externally threaded and in the case illustrated to be provided with a protective cap 92. Upon the removal of the cap 92, the invention system contemplates that the plug 88 may serve as a means for coupling to the housing 10 a bottle of compressed air or, if circumstances so enable, a hose or other conduit serving to couple a source of compressed air to the housing 10 by way of the plug 88. In any event, upon release of the air from the bottle or other source which is connected to the plug 88, it will be obvious that this air under pressure will enter the chamber 82 and be directed by way of the nozzle passages 84 to impinge upon the turbine blades 56 and thereby energize and drive the rotor unit comprised of the blades 52, hub 50 and spinner 60.

Attention is directed to the fact that, as seen in FIG. 2, there are further passages 94 in the wall structure of the housing segment 14 which open at one end to the chamber 82 and at the other end to the innermost ends of cylindrical pockets 96 formed in projections 98 radial to and extending longitudinally of the outer wall surface of the housing segment 14. Viewing FIGS. 1 and 2, it may be seen that the projections 98 and the cylindrical pockets formed thereby are three in number, in the case illustrated, and correspondingly there are three passages 94 in the wall structure of housing segment 14. Housed in each cylindrical pocket 96 is a piston assembly comprised of a rod 100 the outer diameter of which, except for its innermost end, is uniformly smaller than the diameter of the passage 96 in which it is inserted. The rod 100 has a radial expansion forming a piston head 102 integral therewith adjacent the end thereof which is innermost in the pocket 96 of the projection 98 in which it is accommodated. The innermost end of the rod 100 is relatively reduced in diameter to accommodate thereabout a sealing ring 104 which is U-shaped in cross section. A slight external flange 106 on the innermost extremity of the rod 100 serves to retain the seal 104 in its prescribed position and to function in an obvious manner. Coiled about the major portion of the length of the rod 100, to seat at one end to the radial shoulder provided by the face of the piston head 102 remote from the seal 104 and to project outwardly therefrom, is a spring 108. The end of the spring 108 outermost in respect to the pocket in which the assembly thereof with the rod 100 is embodied is established in abutment with the innermost end of a bushing 110 which is threadedly engaged in the outermost end of the wall structure defining the pocket 96, which end is immediately adjacent the inlet end of the housing 10. The bushing 110 serves further as a bearing for the rod 100. As will be seen, therefore, the containment of the spring 108 serves to provide means for biasing the rod 100 to nest inwardly of its pocket 96, in adjacent but spaced relation to the base thereof, the space defined thereby being in communication with the chamber 82 by way of a passage 94. Since the circular chamber 82 is intermediate the length of the passages 96, it will be seen that the passages 94 are angled outwardly from the chamber 82 in the direction of the flow through the passage 12, which will be further described.

Looking further at the piston rod 100, it will be seen that this rod has a central axial recess which forms an axially elongated cup-like cavity which opens outwardly of its outermost end as disposed in a pocket 96. Threaded in this outermost end of this recess, identified by the numeral 112, in an expanded portion thereof formed by a counterbore, is a tubular stud 114 the outer end of which is provided with a radial flange 116 including axial projections 118 which facilitate threading the stud into and out from the rod 100. Adjacent the innermost end thereof, the stud 114 has a reduction in its internal diameter, the inner wall of which reduced portion 120 is internally threaded. This last is to accommodate the coupling thereto of the threaded inner end of a retaining screw assembly 122.

It will be seen that the retaining screws 122 are utilized to fix a closure plate 124 to the outermost ends of the piston rods 100 in the respective pockets 96. The closure plate 124 is adapted, by virtue of the bias on the rods 100 through the medium of the springs 108 to positively fix the plate 124 in bridging relation to the lip 66. A ring seal 126 on the inner surface of the plate 124 seats in this instance, in a sealing relation to the lip 66 and establishes the plate 124 thereby as a seal for the inlet to the flow passage 12 of the housing 10.

As will be obvious, as air under pressure is directed to the chamber 82 and against the turbine blades 56 by way of nozzles 84 it will simultaneously be metered by way of passages 94 to the space provided to the innermost end of the piston rods 100 and against the cup-like face of the seals 104 at the inner ends thereof, to simultaneously pressure the piston rods outwardly of their pockets 96 against the influence of the bias thereon by the springs 108. This, of course, will displace the closure plate 124 in a sense axially from the inlet to the flow passage 12. Simultaneous therewith the rotor embodied in the interior of the housing 10 will be energized by the air under pressure which impinges on and drives the turbine blades 56, as a consequence of which air will be induced to move inwardly of the housing inlet and to and through the flow passage 12 to co-mingle with the fluid under pressure entering by way of the chamber 82 and nozzle passages 84, to substantially instantaneously initiate and very quickly inflate an inflatable object such as a life raft which may be coupled in suitable fashion about the discharge end of the housing 10. In the case illustrated, abutting end portions of the housing segments 14 and 16 are provided with coaxial apertures through which bolts may be applied to couple the housing 10 to a mounting on a life raft, for example, with the discharge end of the housing 10 disposed interiorly of the inflatable article.

Further provided in the interior of the housing 10 is a bar 128 which extends diametrically across the inlet section 70 of the interior wall surface of the housing 10. The bar 128 is embodied in the resilient hinge 130 extending diametrically of a disc shaped flapper valve 132, the respective half portions of which are biased in their normal positions to overlap and abut in sealing relation to the shoulder 72 on the interior wall surface of the housing 10.

It may thus be seen that the inflating unit of the invention embodies two types of seals at the inlet to the housing 10. In the inoperative position of the inflating unit, the main seal is provided by the closure plate 124 which is firmly and positively biased to its sealing position by the piston rods 100 under the influence of springs 108. The nature and manner of application of plate 124 provides that when the inflating unit has been applied to an inflatable object that it will insure a continuing protection of the interior elements of the resultant assembly.

Figure 7:
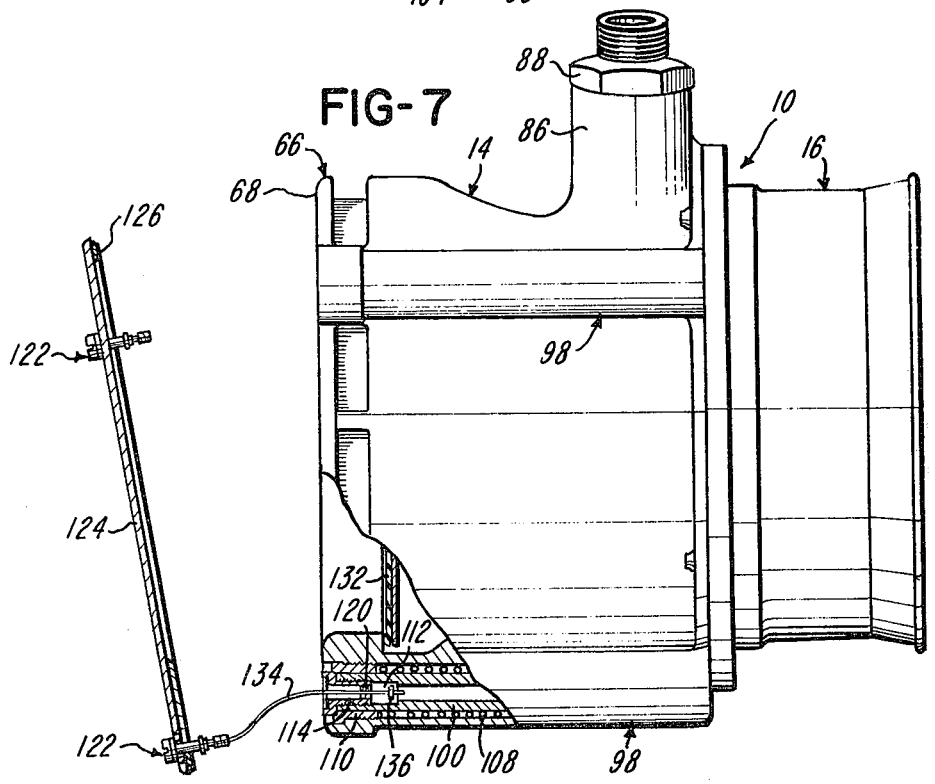
FIG. 7 is a further side elevation view of the pump illustrating a further feature of the pump construction which facilitates maintenance procedures.

Attention is directed to the fact that one of the retaining screw assemblies 122, in the case illustrated, is tubular and has anchored to the innermost end thereof a lanyard 134, which may be a wire, the innermost end of which extends interiorly of the recess in the related piston rod 100 and has coupled thereto a washer-like retaining device 136. As will be seen from FIG. 7 of the drawings, this facilitates that the closure plate 124 may be maintained in connected relation with the housing 10 during maintenance procedures as the three screw assemblies 122 are released from their engagement with the studs 114.

Figure 6:
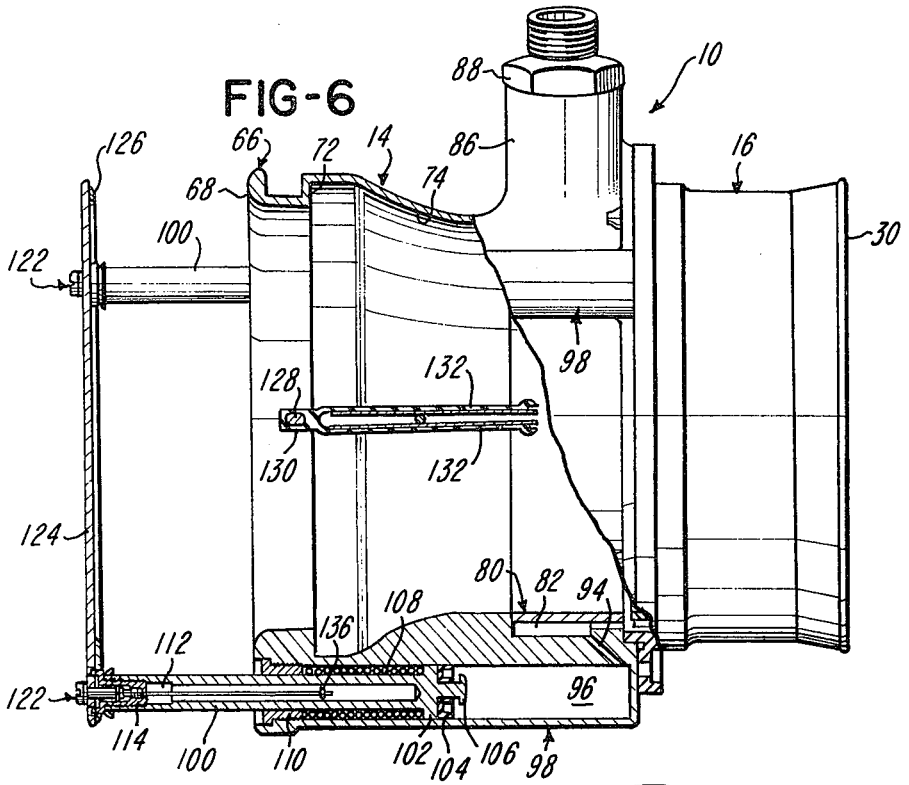
FIG. 6 is a side elevation view, shown partially in section, of the pump structure of FIGS. 1 and 2 with the sealing means thereof in a displaced position as occasioned by the energizing of the pump for inflating purposes.

From the foregoing it will be clear that as air under pressure from a bottle or other source of air under pressure is released to enter the chamber 82, that simultaneously this air, under pressure, will pass through the nozzle passages 84 to impinge on the turbine blades 56 and through the passages 94 in the housing wall structure to apply pressure against the seals 104 at the inner ends of the piston rods 100. The bias on the rods 100 is such that as the pressure builds up in the chamber 82 to about 100 p.s.i.g. that the piston rods are pushed outwardly to axially displace the closure plate 124, which otherwise forms a seal of the inlet to the flow passage 12. The conditions thus provided insures that there is a displacement of the inlet seal substantially simultaneously with the operative energizing of the rotor in the flow passage 12. With the arrangement provided, if at the time of need the inflating unit is partially immersed in or exposed to water, the plate 124 will provide a buffered displacement of water and inhibit entry of water to the flow passage 12 as the rotor is energized to produce an insuction of air to the article to be inflated. The amount of air which the unit defined by the housing 10 is capable of introducing to the article to be inflated is such and the speed of inflation achieved thereby is so rapid, as assisted by the shield afforded by the displaced plate 124, that an adequate inflation of the coupled inflatable object is insured. Of course, with insuction, the inner flapper seal is displaced as seen in FIG. 6 of the drawings.

As inflation occurs, a prescribed amount of compressed air will have to be delivered for inflation of the object coupled to the housing 10. The necessary air can be provided in a bottle, for example, as in the case of the application illustrated, in which event the bottle will exhaust in achieving the desired result. Consequently upon substantial completion of inflation there will be a back pressure in the housing 10 which will induce the flapper seal 132 to close. Also springs 108 will then be conditioned to return the plate 124 to seal the inlet to the flow passage 12 due to termination of flow of fluid under pressure through the passages 94. Under such conditions the inlet to the inflating unit as well as the inflated object is thereby sealed to preclude escape of air and maintain the effectiveness of the inflated object for the purpose intended.

The advantages enabled by the invention are self-evident and achieve a degree of safety in use thereof not comprehended by apparatus of the prior art.

In addition to the benefits of the structure provided for sealing and operating the seal afforded for the invention unit, attention is directed to the fact that the construction of the housing 10, in the simplified form illustrated and with the contour of the flow passage as provided, produces an efficiency in operation and an economy of construction affording significant advance over prior art devices directed to similar purposes. An unobvious benefit of the invention unit is that once applied to an inflatable object, the application of suction to the interior of such object through an access opening separate from that sealed by the inflating unit, insures its complete evacuation of air and debris. This enables that the inflatable object may be folded to occupy a minimal space.

A further application of the invention is schematically shown in FIG. 8 of the drawings, embodied in a vehicle which could an airborne, terrestrial or marine vehicle designed to hover and to move over and in spaced relation to a ground or water surface. FIG. 8 shows the general outline of an aircraft fuselage 200 which has as its undercarriage an elastic inflatable trunk 202. The trunk 202 may be suitably connected and have a variety of shapes. However, for the purpose of a descriptive illustration it is shown to have a toroidal shape.

As schematically shown in a generally sectional view, the interior of the fuselage is vertically bridged by a duct work 204 including two generally parallel sections 206 and 208 the upper ends of which open through upper portions of the fuselage skin. The lower ends of the sections 206 and 208 merge with and are continued by a common lower duct section 210. The latter opens from the under surface of the fuselage 200 in an area thereof surrounded by the innerconnected inner periphery of the trunk 202.

It is to be understood that the term "parallel", in respect to the sections 206 and 208 is here intended to designate sections which are functionally parallel and not necessarily literally parallel. There is no limitation on the precise configuration of the duct work except that the upper ends open from upper portions of the fuselage skin while the lower end or ends should be arranged to open from the fuselage within the inner periphery of the trunk 202.

Fixed in transverse bridging relation to each of the duct sections 206 and 208, intermediate their vertical limits, is a unit 10 such as illustrated in FIGS. 1 through 7 of the drawings. These units are identical in all respects with the exception that one is oriented reversely to the other. In the duct section 208 the longitudinal axis of the unit 10 is positioned coaxial with the duct section and the inlet end of the unit is disposed uppermost. In the duct section 206 the unit 10 is oriented with its inlet end lowermost.

It is to be noted that in this application the units 10 serve as air pumps and their outlets 38 are open for free discharge of the developed air flow.

Further, it will be understood that there will be provided in connection with each of the units 10 a source of fluid under pressure which is connected for delivery to its chamber 82 and delivery by the associated nozzles to impact on the turbine blades in connection with its rotor 22. The source of fluid under pressure is not here illustrated since it can be provided in various manner by one versed in the art having the inflating unit of the invention before him. Additionally, there will be conventional means for controlling the furnishing of the fluid under pressure to the chambers 82 of the pump units 10 at appropriate times to achieve, by a selective energizing thereof, a lift and flotation of the fuselage 200 or a landing or braking thereof. The options are illustrated in FIGS. 8 and 9 of the drawings. FIG. 8 illustrates lift and flotation while the FIG. 9 illustrates a condition wherein the vehicle is landed or braked.

Thus, the schematic illustrations of FIGS. 8 and 9 provide only such details as are necessary for an understanding of the improved system of the invention referenced to lift and flotation or landing and braking of a vehicle the undercarriage of which is furnished by an inflatable trunk. It is to be understood that the source of fluid under pressure for energizing the units 10 may be the same source which is provided and controlled to selectively inflate or provide for deflation of the trunk 202.

In any event, referring to FIG. 8, with the trunk 202 inflated and a desire to place the vehicle fuselage 200 in a lift or flotation position, the invention contemplates that the unit 10 in the duct section 208 will be energized while the unit 10 in the duct section 206 is maintained in an unenergized condition. Due to its orientation in the duct section 206, as long as the unit 10 remains unenergized it will have its inlet sealed by the closure plate 124 as illustrated in FIG. 8. This is a positive seal and also seals the duct section 206 against passage of air. On the other hand, on an energizing of the rotor 22 in the unit 10 in the duct section 208, induced by the delivery of fluid under pressure to its chamber 82, its closure plate 124 will be simultaneously and instantaneously displaced as previously described. As this happens, air is drawn from above the vehicle fuselage 200 through the upper end of the duct section 208. The latter is enlarged about the inlet end of the unit 10 to afford passage of this air past the closure plate 124, and into and through the associated housing. This air will be directed, under the pumping pressure, through the lower end of the section 208, the outlet section 210 and into the cavity defined by the toroidal shape of the trunk 202. As the fluid under pressure fills this cavity, it cannot back up into the duct section 206 due to the closure provided at the inlet end of the pumping unit 10 which bridges this duct section. As a result of the delivery of air under pressure into the pocket defined by the inflated trunk 202, when the vehicle is resting on the ground, the air will be pressured to move outwardly from the inner periphery of the trunk by way of the undersurface thereof. This produces a film of flowing fluid which separates the trunk from the ground surface and induces the lift or flotation such as illustrated in FIG. 8.

If the vehicle represented by the fuselage 200 is in a flotation state such as illustrated in FIG. 8 and the operator desires to brake or land the vehicle, then the unit 10 in the duct section 208 must be in a deenergized condition and that in the duct section 206 energized. Due to the reverse orientation of the unit 10 in the duct section 206, energizing thereof displaces its closure plate 124 to permit that it draw air from the pocket defined by the inner periphery of the trunk 202 and away from the under surface of the inflated trunk. This causes a negative pressure below the trunk which produces a gradual lowering of the trunk to the adjacent ground or other surface which defines its reference plane. The net effect is believed obvious and the result is the showing in FIG. 9. Of course, throughout this procedure the pumping unit in the duct section 208 remains sealed and prevents an insuction of air past its housing.

The invention system thus provides the application of two turbofan units such as just described in parallel relation but reversed to produce opposing directions of flow to control the pressure under the trunk 202 as needs require.

The invention thus enables the selective lift or lowering of the fuselage 200 with reference to a base plane or surface and the positive closure aspects of the unit 10 insure optimal efficiency in directing air under pressure to or from the vicinity of the base of its inflated undercarriage. The system may similarly function in any vehicle designed to hover in an adjacent spaced relation to a ground or water surface. Of course, there may be variations of the invention concept which is only schematically illustrated in FIG. 8 but fundamental thereto is the arrangement of duct work wherein the units by virtue of their characteristics and provide a positive seal of selective duct sections and positive direction of air to serve the required needs.

The embodiments of the invention in which an exclusive property or privilege is claimed are defined as follows:

1. Apparatus for producing a flow of air under pressure having particular advantage for use in inflating inflatable articles, particularly those applied to safety purposes, comprising a housing having an inlet thereto and an outlet therefrom, a portion of said housing defining a flow passage interconnecting said inlet and said outlet, a rotor in said flow passage the operation of which will induce a through flow of air under pressure, said rotor including peripherally projected blade segments positioned adjacent and in following relation to a shoulder defined in said flow passage in facing relation to said outlet, the portion of said housing defining said flow passage having formed therein immediately preceding said shoulder a chamber receiving a fluid under pressure from which chamber pressure fluid is directed to drive said blades and thereby to drive said rotor, means in connection with said housing for normally sealing said inlet, the wall structure of said housing embodying means defining axially extended pockets opening from the inlet thereof, in which pockets are contained piston means in connection with said sealing means, said piston means having in connection therewith means for biasing the same in a direction to cause said sealing means to maintain a seal of said inlet and passages defined in said housing communicating said chamber with said piston means to influence the axial displacement of said sealing means substantially simultaneously with the drive of said rotor.

2. Apparatus as in claim 1 characterized by said sealing means having a plate form and being releasably connected to said piston means and there being means defining a releasable connection for one of said means connecting said plate to one of said pistons which prevents the complete release of said plate from said housing.

3. Apparatus for producing a flow of air under pressure having particular advantage for use in inflating inflatable articles, particularly those applied to safety purposes, comprising a housing having an inlet thereto and an outlet therefrom, means defining a flow passage interconnecting said inlet and said outlet, pumping means in said flow passage the operation of which will induce a through flow of air under pressure, means in connection with said housing for directing motive power to operate said pumping means, means in connection with said housing for normally sealing said inlet, said sealing means being so arranged with respect to said inlet that fluids attempting to enter said flow passage through said inlet are applied to said sealing means in a direction to maintain said inlet sealed, said sealing means having means in connection therewith for influencing said sealing means to unseal said inlet substantially simultaneously with the application of motive power to energize said pumping means, said means in connection with said housing for directing motive power to operate said pumping means including a chamber in the wall of said housing which is displaced from said flow passage and substantially circumscribes said flow passage in its displaced position, in a sense generally concentric thereto, and means defining passages in said housing wall structure for communicating fluid under pressure introduced to said chamber with said sealing means to produce a displacement thereof upon motive power being furnished said pumping means.

4. Apparatus for producing a flow of air under pressure having particular advantage for use in inflating inflatable articles, particularly those applied to safety purposes, comprising a housing having an inlet thereto and an outlet therefrom, means defining a flow passage interconnecting said inlet and said outlet, pumping means in said flow passage the operation of which will induce a through flow of air under pressure, means in connection with said housing for directing motive power to operate said pumping means including a pressure fluid receiving chamber in the wall of said housing which is displaced from said flow passage and substantially circumscribes said flow passage in its displaced position, in a sense generally concentric thereto, said housing being defined by a wall structure which includes a plurality of pockets therein extending generally axially thereof and opening from one end adjacent said inlet, means defining passages in said housing wall structure for communicating fluid under pressure introduced to said chamber with said pockets substantially simultaneously with the directing of pressure fluid from said chamber to operate said pumping means, means in connection with said housing for normally sealing said inlet, and said sealing means being a closure plate for said inlet having means projected in and mounted for axial movement within said pockets, through which said last mentioned means fluid under pressure directed through said communicating passages to said pockets operates to displace said closure plate.

5. Apparatus as in claim 4 characterized by means in said pockets for applying a bias to influence said closure plate to achieve and maintain a seal of said inlet.

6. Apparatus for producing a flow of air under pressure having particular advantage for use in inflating inflatable articles, particularly those applied to safety purposes, comprising a housing having an inlet thereto and an outlet therefrom, means defining an axial flow passage in said housing one end of which provides the inlet to said housing and the other end of which provides the outlet therefrom, pumping means in said flow passage the operation of which will induce a through flow of air under pressure, means in connection with said housing for directing motive power to operate said pumping means and means in connection with said housing for normally sealing said inlet, said sealing means having means in connection therewith for influencing said sealing means to unseal said inlet on application of motive power to energize said pumping means, said sealing means being a plate-like structure having in connection therewith piston means mounted to said housing and providing for an axial movement of said plate-like structure to and from a sealing relation to said inlet, and means for mounting said plate-like structure to said housing and providing for separation of said plate-like structure while maintaining a connected relation thereof to said housing.

7. Apparatus as in claim 6 characterized by said means for mounting said plate-like structure to said housing including connector elements releasably connecting said plate-like structure to said piston means and one of said releasable connecting means having in connection therewith a lanyard providing for a displacement of said releasable connecting means while maintaining a connected relation of said plate-like structure with said housing.

8. Apparatus for producing a flow of air under pressure having particular advantage for use in inflating inflatable articles, particularly those applied to safety purposes, comprising a housing providing a flow passage having an inlet thereto and an outlet therefrom, said inlet defining peripherally thereof a valve seat, a valve member engageable on said valve seat to close said inlet and positioning to be urged on to said seat by fluids attempting to enter said inlet, fluid pressure operated means in connection with said housing projectible to lift said valve member from said valve seat to open said passage to a flow of fluid therethrough, means including a pressure fluid receiving chamber in said housing, in common communication with said flow passage and with said fluid pressure operated means, arranged to direct fluid to project said projectible means and to substantially simultaneously induce a flow of fluid through said passage, said fluid pressure operated means including pistons housed in a series of pressure fluid cylinders arranged circumferentially of said housing and said pistons being exposed at their one ends to pressure fluid admitted to said cylinders and extending at their other ends into a supporting connected relation to said valve member.

9. Apparatus according to claim 8, wherein said flow passage has an expanded entrance end at said inlet and said valve has the construction of a flat disc supported by said pistons.

10. Apparatus for producing a flow of air under pressure having particular advantage for use in inflating inflatable articles, particularly those applied to safety purposes, comprising a housing having an inlet thereto and an outlet therefrom, means defining a flow passage interconnecting said inlet and said outlet, pumping means in said flow passage the operation of which will induce a through flow of air under pressure, a plate-like structure for normally sealing said inlet having in connection therewith piston means mounted to said housing and providing for an axial movement of said plate-like structure to and from a sealing relation to said inlet, said housing having a chamber for receiving fluid under pressure, said chamber being an annular chamber surrounding said flow passage and said pumping means having the character of a tip turbine located in said flow passage in adjacent relation to said chamber, and passages in said housing for substantially simultaneously passing pressure fluid from said chamber to said flow passage to serve as motive power to operate said pumping means and to direct pressure fluid to said piston means to influence said plate-like structure to unseal said inlet.

11. Apparatus according to claim 10, wherein said piston means are housed in cylinders in connection with said housing and said housing passages include portions thereof which directly communicate said chamber with said cylinders.

* * * * *